US007932918B2

(12) United States Patent
Yamamoto

(10) Patent No.: US 7,932,918 B2
(45) Date of Patent: Apr. 26, 2011

(54) EXPOSURE APPARATUS, IMAGE FORMING APPARATUS, EXPOSURE APPARATUS MANUFACTURING METHOD AND IMAGE FORMING METHOD

(75) Inventor: Yoshihiro Yamamoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 651 days.

(21) Appl. No.: 11/962,351

(22) Filed: Dec. 21, 2007

(65) Prior Publication Data

US 2008/0232855 A1 Sep. 25, 2008

(30) Foreign Application Priority Data

Mar. 22, 2007 (JP) ..... 2007-075383

(51) Int. Cl.
*B41J 27/00* (2006.01)
*B41J 2/385* (2006.01)
*G03G 13/04* (2006.01)

(52) U.S. Cl. ..... 347/257; 347/115; 347/117; 347/118; 347/129; 347/130; 347/132; 347/134; 347/137; 347/138; 347/224; 347/256; 347/258; 347/259; 347/260; 347/261; 347/262; 347/263

(58) Field of Classification Search ..... 347/118, 347/134, 137, 256, 257
See application file for complete search history.

(56) References Cited

U.S. PATENT DOCUMENTS

2004/0100673 A1* 5/2004 Sakai et al. ..... 359/216
2006/0262177 A1 11/2006 Wada et al.

FOREIGN PATENT DOCUMENTS

CN 1866072 A 11/2006
JP 2005-156914 A 6/2005

OTHER PUBLICATIONS

Chinese Office Action corresponding to Chinese Patent Application No. 200810006001.1 dated Dec. 11, 2009.

* cited by examiner

*Primary Examiner* — Ryan Lepisto
(74) *Attorney, Agent, or Firm* — Sughrue Mion, PLLC

(57) ABSTRACT

The exposure apparatus is provided with: an optical member; and a holding member that holds the optical member. Both end portions of the optical member are held by the holding member with a first adhering unit that is cured by light irradiation for first duration and a second adhering unit that is cured by light irradiation for second duration which is longer than the first duration.

13 Claims, 7 Drawing Sheets

EXPOSURE APPARATUS, IMAGE FORMING APPARATUS, EXPOSURE APPARATUS MANUFACTURING METHOD AND IMAGE FORMING METHOD

CROSS REFERENCE TO RELATED APPLICATIONS

This application is based on and claims priority under 35 USC §119 from Japanese Patent Application No. 2007-075383 filed Mar. 22, 2007.

BACKGROUND

1. Technical Field

The present invention relates to an image forming apparatus and an exposure apparatus which writes information by light in an image forming apparatus such as a printer and a copy machine, an exposure apparatus manufacturing method and the image forming method.

2. Related Art

In a color image forming apparatus of an electrophotographic type such as a printer and a copying machine, there is a known apparatus constituted by arranging a photoconductor drum and an exposure apparatus for each color. In such a color image forming apparatus, since each exposure apparatus scans and exposes each photoconductor drum with laser beam that is modulated in accordance with image data for each color, there is a need for preliminarily and accurately setting an exposure position on the photoconductor drum in each exposure apparatus.

SUMMARY

According to an aspect of the present invention, there is provided an exposure apparatus including: an optical member; and a holding member that holds the optical member. Both end portions of the optical member is held by the holding member with a first adhering unit that is cured by light irradiation for first duration and a second adhering unit that is cured by light irradiation for second duration which is longer than the first duration.

BRIEF DESCRIPTION OF THE DRAWINGS

Exemplary embodiment(s) of the present invention will be described in detail based on the following figures, wherein.

DETAILED DESCRIPTION

First Exemplary Embodiment

Hereinafter, the first exemplary embodiment of the present invention will be described in detail with reference to the accompanying drawings.

Figure 1:
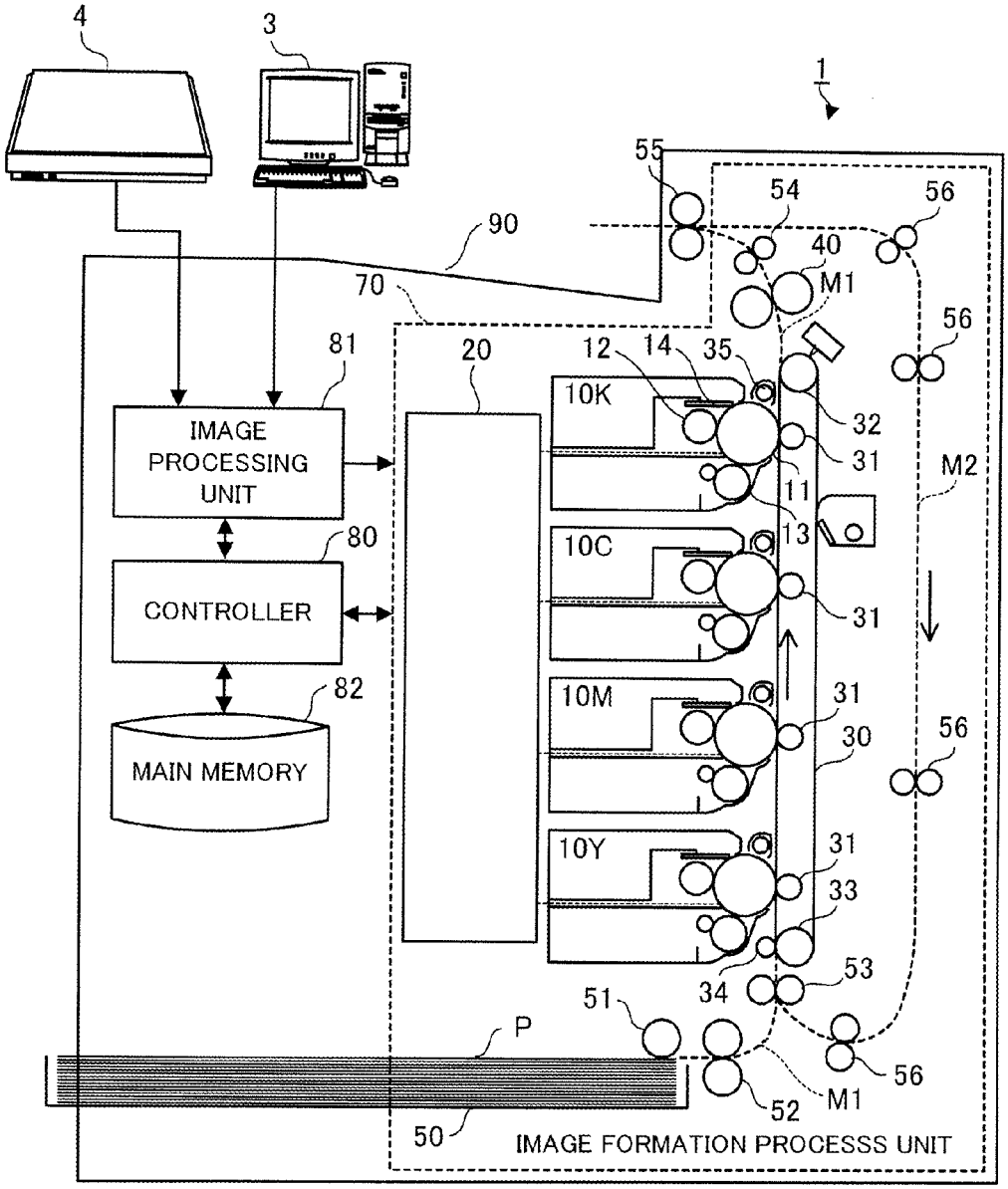
FIG. 1 is a view showing an example of a configuration of an image forming apparatus to which the first exemplary embodiment is applied.

FIG. 1 is a view showing an example of a configuration of an image forming apparatus 1 to which the first exemplary embodiment is applied. An image forming apparatus 1 shown in FIG. 1 is what is termed as a tandem-type digital color printer with electrophotography as an example of an image forming device, and includes an image formation process unit 70, a controller 80, an image processing unit 81 and a main memory 82. Specifically, the image formation process unit 70 forms an image in response to image data of each color. The controller 80 controls the entire operations of the whole image forming apparatus 1. The image processing unit 81 performs certain image processing on image data received from, for example, a personal computer (PC) 3, an image reading apparatus 4 such as a scanner and the like. The main memory 82 is realized by, for example, a hard disk (hard disk drive) on which processing programs, image data and the like are recorded.

In the image forming process unit 70, four image forming units 10Y, 10M, 10C and 10K (hereinafter, collectively referred to as the "image forming unit 10") are arranged in parallel at a fixed interval in the up and down direction (substantially vertical direction). The image forming unit 10 is provided with a photoconductor drum 11 serving as an image holding body (and an exposed body), an electrically charging roll 12 that electrically charges a surface of the photoconductor drum 11, a developing unit 13 that develops an electrostatic latent image formed on the photoconductor drum 11 by each color toner, and a drum cleaner 14 that cleans the surface of the photoconductor drum 11 after transfer.

The image forming unit 10 is formed detachably from a main body of the image forming apparatus 1. For example, in the case where the toner within the developing unit 13 is consumed, the photoconductor drum 11 comes to the end of the life or the like, the image forming unit 10 is exchanged.

The electrically charging roll 12 is formed by a roll member in which a conductive elastic-body layer and a conductive surface layer are successively laminated on a conductive core such as aluminum and stainless steel. The electrically charging roll 12 receives an electrically charging bias pressure from an electrically charging power source (not shown), and while rotating driven by the photoconductor drum 11, electrically charges the surface of the photoconductor drum 11 uniformly at a fixed potential.

In each the image forming unit 10, the developing unit 13 holds a two-component developer consisting of each color toner of yellow (Y), magenta (M), cyan (C) and black (K) and a magnetic carrier, and develops the electrostatic latent image formed on the photoconductor drum 11 by each color toner.

The drum cleaner 14 brings a plate member that is formed by a rubber material such as urethane rubber into contact with the surface of the photoconductor drum 11, and removes the toner, paper dust and the like that are adhered on the photoconductor drum 11.

Moreover, in the image forming apparatus 1 according to the first exemplary embodiment, a laser exposing unit 20 serving as an example of an exposure device (exposure apparatus) that exposes the photoconductor drum 11 arranged respectively in each image forming unit 10 is provided. The laser exposing unit 20 acquires image data for each color from an image processing unit 81. By laser beam that is controlled for lighting on the basis of the acquired image data, the laser exposing unit 20 scans and exposes on the photoconductor drum 11 of each image forming unit 10, respectively.

Further, so as to move while in contact with the photoconductor drum 11 of each image forming unit 10, a paper conveying belt 30 that conveys a paper P serving as a recording material (recording paper) is arranged. The paper conveying belt 30 is formed by an endless belt in a film shape that electrostatically absorbs the paper P. Then the paper conveying belt 30 is hanged between a drive roll 32 and an idle roll 33 and cyclically moved. Between the paper conveying belt 30 and the photoconductor drum 11, a paper conveying route M1 is formed for conveying the paper P from the lower side to the upper side in the substantially vertical direction.

In positions inside the paper conveying belt 30 and opposed to each photoconductor drum 11, a transfer roll 31 is arranged respectively. Each transfer roll 31 forms a transfer electric field between the transfer roll 31 and the photoconductor drum 11 so as to successively transfer a toner image of each color that is formed in each image forming unit 10 on the paper P that is held and conveyed by the paper conveying belt 30. Further, on the outside of the paper conveying belt 30, and on the downstream side of each transfer roll 31, a discharge lamp 35 that removes electricity of the photoconductor drum 11 after the transfer is provided.

In the most upstream portion on the side where the photoconductor drum 11 of the paper conveying belt 30 is located, an absorption roll 34 that electrically charges the paper conveying belt 30 is arranged. The absorption roll 34 electrically charges a surface of the paper conveying belt 30 at a predetermined potential so that the paper P is stably electrostatically absorbed.

On the downstream side of the paper conveying belt 30 along the paper conveying route M1, a fixing unit 40 that performs a fixing treatment to a non-fixed toner image on the paper P with heat and pressure is provided.

Further, as a paper conveying system other than the paper conveying belt 30, on the paper supplying side, a paper housing unit 50 that houses the paper P, a pickup roll 51 that takes out the paper P housed in the paper housing unit 50 at a predetermined timing and conveys the paper P, a conveying roll 52 that conveys the paper P brought by the pickup roll 51, and a resist roll 53 that feeds the paper P to the paper conveying belt 30 corresponding to an image forming operation are provided.

Meanwhile, on the paper discharging side, a paper discharging roll 54 and a reverse roll 55 are provided. The paper discharging roll 54 conveys the paper P fixed in the fixing unit 40. The reverse roll 55, in the case of single side printing, discharges the paper P to a paper discharging unit 90 provided on an upper portion of the main body of the apparatus, whereas the reverse roll 55, in the case of both-side printing, rotates in the reverse direction to the rotational direction towards the paper discharging unit 90 at a predetermined timing so as to feed the paper P whose one side surface is fixed in the fixing unit 40 to a both-side conveying route M2. In addition, in the both-side conveying route M2, plural conveying rolls 56 are provided along the both-side conveying route M2.

In the image forming apparatus 1 according to the first exemplary embodiment, the image forming process unit 70 performs the image forming operation under control by a controller 80. That is, an image treating unit 81 performs a predetermined image treatment to the image data inputted from PC3, an image reading apparatus 4 or the like, and the image data is supplied to the laser exposing unit 20. Then, for example, in the image forming unit 10K of black (K), the surface of the photoconductor drum 11 that is uniformly electrically charged by the electrically charging roll 12 at a predetermined potential is scanned and exposed with the laser beam that is controlled for lighting by the laser exposing unit 20 on the basis of the image data from the image treating unit 81, and the electrostatic latent image is formed on the photoconductor drum 11. The formed electrostatic latent image is developed by the developing unit 13, and on the photoconductor drum 11, a toner image of black (K) is formed. In the image forming units 10Y, 10M and 10C, in a similar manner, toner images each color of yellow (Y), magenta (M) and cyan (C) are formed.

Meanwhile, when formation of the toner image of each color in each image forming unit 10 is started, the paper P that is taken out from the paper housing unit 50 is supplied to the paper conveying belt 30 by the resist roll 53 corresponding to a formation timing of the toner image. The surface of the paper conveying roll 30 is electrically charged by the absorption roll 34 at a predetermined potential. Thereby, the paper P is electrostatically absorbed on the paper conveying belt 30. By the paper conveying belt 30 that is cyclically moved in the arrow direction of FIG. 1, the paper P is conveyed along the paper conveying route M1. In the middle course of the conveying, by the transfer electric field that is formed by the transfer roll 31, the toner image of each color is successively transferred on the paper P.

The paper P where the toner image of each color is electrostatically transferred is detached from the paper conveying belt 30 on the downstream of the image forming unit 10K, and conveyed to the fixing unit 40. When the paper P is conveyed to the fixing unit 40, the non-fixed toner image on the paper P is fixed to the paper P by receiving the fixing treatment with heat and pressure. The paper P where the toner image of each color is fixed is loaded in the paper discharging unit 90 that is provided in a discharging portion of the image forming apparatus 1. Meanwhile, at the time of both-side printing, after a similar image forming operation is performed again via the both-side conveying route M2, the paper P is loaded in the paper discharging unit 90.

Next, a description is given to the laser exposing unit 20 according to the first exemplary embodiment.

Figure 2:
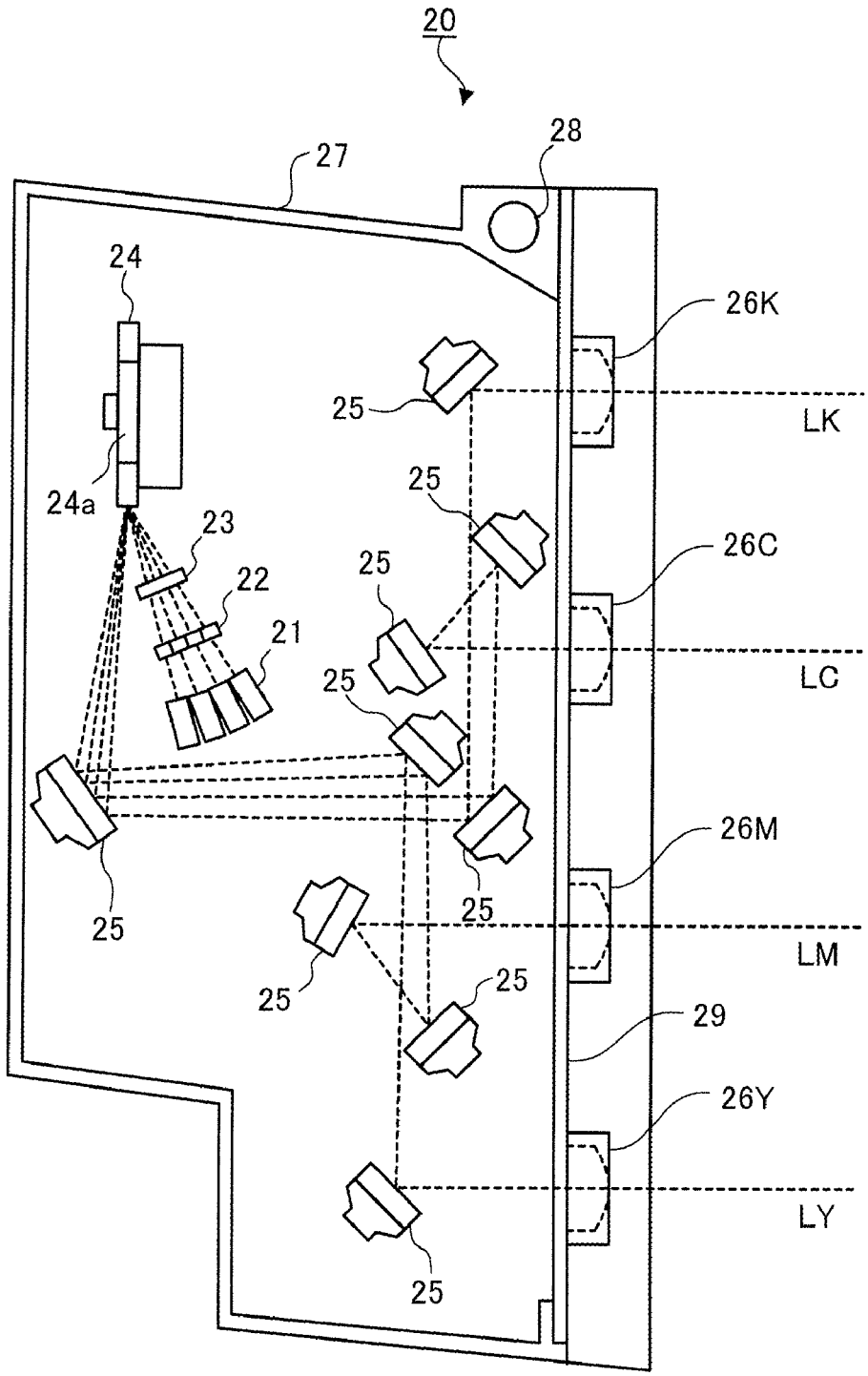
FIG. 2 is a side view that explains a schematic configuration of the laser exposing unit according to the first exemplary embodiment.

FIG. 2 is a side view that explains a schematic configuration of the laser exposing unit 20 according to the first exemplary embodiment. As shown in FIG. 2, the laser exposing unit 20 is provided with, for example, a light source 21 including four semiconductor lasers. Further, as an example of an optical member, the laser exposing unit 20 is provided with four collimator lenses 22 that are provided corresponding to each laser beam from the light source 21, a cylinder lens 23, a rotational polygon mirror 24 that is formed by, for example, a regular hexahedron, plural reflecting mirrors 25, a polygon mirror side lens that constitutes one side of a fθ lens (not shown), and four irradiation side lenses 26K, 26C, 26M and 26Y that constitute the other side of the fθ lens. Moreover, the laser exposing unit 20 is configured within a housing 27 serving as an example of a holding member, and suppresses leakage of the laser beam to the exterior and adhesion of dust and the like to each optical member. Further, the laser exposing unit 20 is provided with a supporting shaft 28 that is integrally provided with the housing 27 for installing within the image forming apparatus 1, and a lens supporting frame 29 that constitutes a part of the holding member fixing the irradiation side lenses 26K, 26C, 26M and 26Y.

In the laser exposing unit 20 according to the first exemplary embodiment, four divergent laser beams that are irradiated from the light source 21 are converted into parallel light by each collimator lens 22 respectively. By the cylinder lens 23 that has a refracting force only in the sub-scanning direction, the laser beams are formed into line images that are long in the main scanning direction in the vicinity of a biased reflection surface 24*a* of the polygon mirror 24. Each laser beam is reflected by the biased reflection surface 24*a* of the polygon mirror 24 that rotates at constant and high velocity and scanned at angular velocity.

Each laser beam passes through the polygon mirror side lens that constitutes the fθ lens, and the direction thereof is changed by the plural reflecting mirrors 25 to a direction towards the surface of the photoconductor drum 11. The laser beam scans and exposes the surface of the photoconductor drum 11 of each image forming unit 10 from the irradiation side lenses 26K, 26C, 26M and 26Y. Here, the polygon mirror side lens and the irradiation side lenses 26K, 26C, 26M and 26Y that constitute the fθ lens respectively have a function of making scanning velocity of an optical spot of the laser beam constant on the photoconductor drum 11.

The line images mentioned above are formed in the vicinity of the biased reflection surface 24*a* of the polygon mirror 24. The fθ lens forms the optical spot on the surface of the photoconductor drum 11 taking the biased reflection surface 24*a* as an object point relative to the sub-scanning direction. Therefore, the above scanning optical system has a function of correcting a surface tangle error of the biased reflection surface 24*a*.

In such a laser exposing unit 20, the laser beams LK, LC, LM and LY that are irradiated from the irradiation side lenses 26K, 26C, 26M and 26Y respectively scan and expose the photoconductor drums 11 of the image forming units 10K, 10C, 10M and 10Y. Therefore, exposure positions in the main scanning direction and the sub-scanning direction on the photoconductor drum 11 is set in the manufacturing process in a plant so that the laser beams LK, LC, LM and LY respectively scan predetermined exposure positions of the photoconductor drum 11 that are provided in the image forming units 10K, 10C, 10M and 10Y. The setting of the exposure positions is mainly performed by adjusting a set angle of each reflecting mirror 25. However, there is a need for setting the exposure positions in the main scanning direction and the sub-scanning direction on the photoconductor drum 11 with extremely high accuracy. Therefore, in the final stage of setting the exposure positions, the laser exposing unit 20 is installed in a measuring apparatus, the laser beams are actually emitted, and while measuring the exposure positions of the laser beams that are irradiated from the irradiation side lenses 26K, 26C, 26M and 26Y, the set angles of the irradiation side lenses 26K, 26C, 26M and 26Y are fine-adjusted so as to match designed values. At the end, in a state where the exposure positions matches to the designed values, the irradiation side lenses 26K, 26C, 26M and 26Y are fixed to the housing 27. Thereby, the exposure positions in the main scanning direction and the sub-scanning direction in the laser exposing unit 20 are set.

Figure 3:
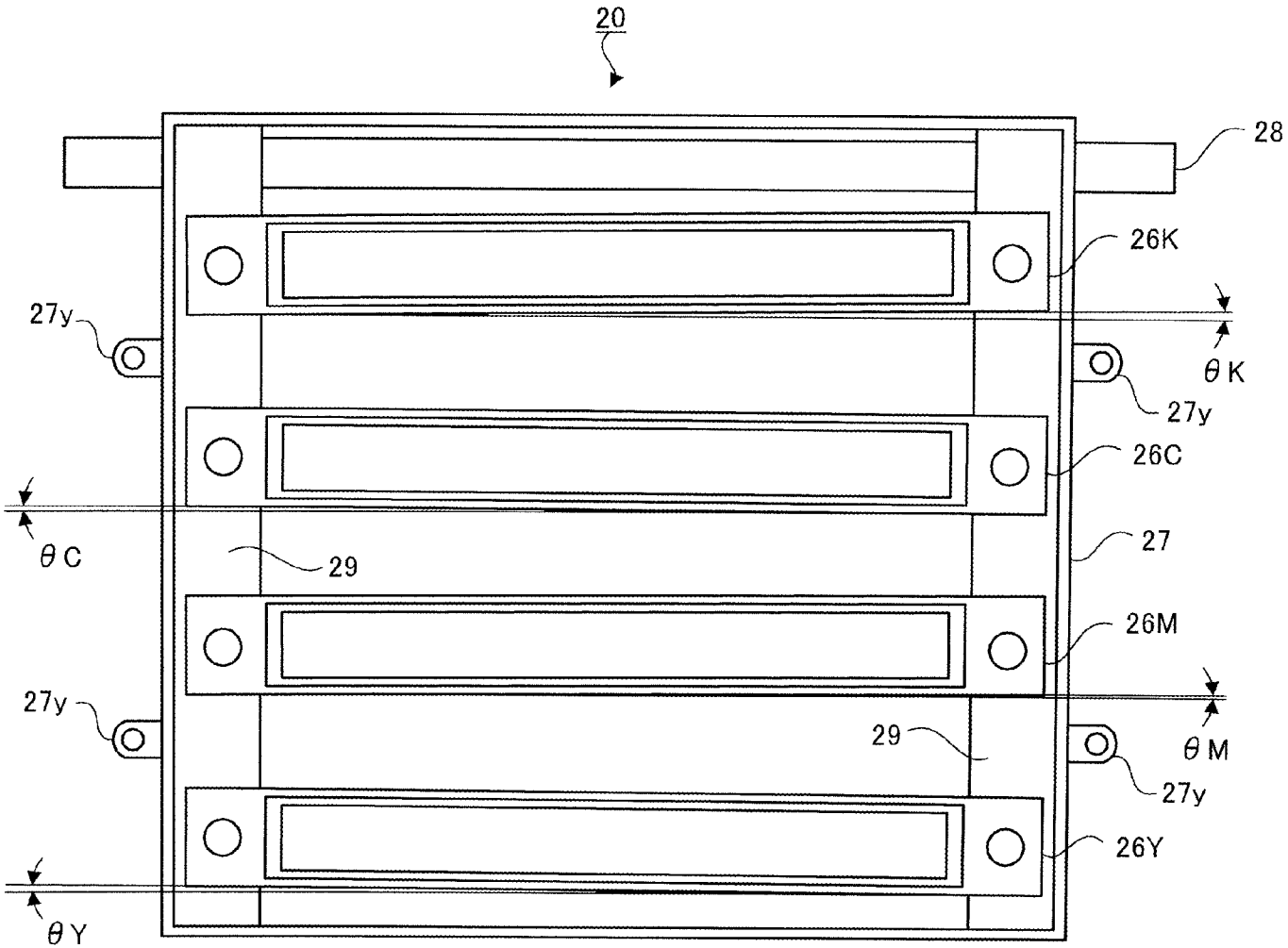
FIG. 3 is a front view where the laser exposing unit is seen from each image forming unit.

FIG. 3 is a front view where the laser exposing unit 20 is seen from each image forming unit 10. As shown in FIG. 3, on each image forming unit 10 side of the laser exposing unit 20, the irradiation side lenses 26K, 26C, 26M and 26Y serving as an example of the optical member are arranged. By the measuring apparatus mentioned above, irradiation positions of the laser beams that are irradiated from each of the irradiation side lenses 26K, 26C, 26M and 26Y are measured. On the basis of measured values, set angles θ of the irradiation side lenses 26K, 26C, 26M and 26Y are fine-adjusted by a holding jig 100 (refer to FIG. 4 on the lower side). For example as shown in FIG. 3, the set angles θ are adjusted by an angle of θK for the irradiation side lens 26K, an angle of θC for the irradiation side lens 26C, an angle of θM for the irradiation side lens 26M and an angle of θY for the irradiation side lens 26Y so that the exposure positions in the main scanning direction and the sub-scanning direction in the laser exposing unit 20 is set at predetermined positions (set values) of the photoconductor drum 11. Then, when the adjustment is finished, the irradiation side lenses 26K, 26C, 26M and 26Y are fixed to the lens supporting frame 29. Therefore, until the adjustment with using the measuring apparatus is finished, the irradiation side lenses 26K, 26C, 26M and 26Y are held by the holding jig 100 in a state where the irradiation side lenses 26K, 26C, 26M and 26Y are not fixed to the housing 27.

Further, it may be configured such that not only the set angles θ of the irradiation side lenses 26K, 26C, 26M and 26Y but also the up and down direction and the left and right direction of the irradiation side lenses 26K, 26C, 26M and 26Y may be adjusted by the holding jig 100.

Figure 4:
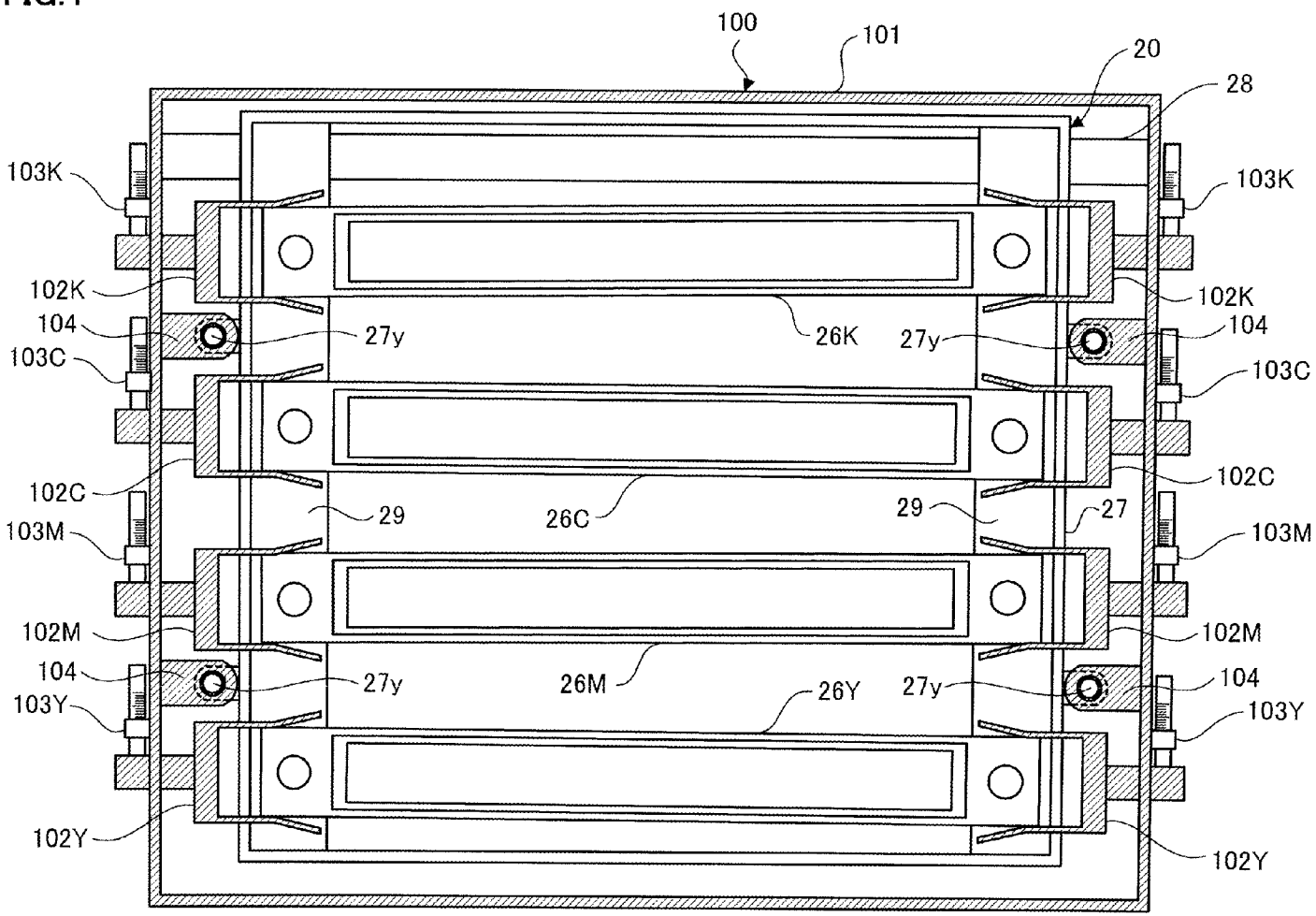
FIG. 4 is a front view where the laser exposing unit at the time of setting the exposure positions is seen from the photoconductor drum.

FIG. 4 is a front view where the laser exposing unit 20 at the time of setting the exposure positions is seen from the photoconductor drum 11. In FIG. 4, the measuring apparatus (not shown in the figure) is placed on the front side of the figure, and the laser beams from the irradiation side lenses 26K, 26C, 26M and 26Y are irradiated towards the front side of the figure.

As shown in FIG. 4, at the time of measurement by the measuring apparatus, the holding jig 100 that is integrally installed with the measuring apparatus is attached to the laser exposing unit 20. The attachment is performed as a first process in the manufacturing process of the laser exposing unit 20 according to the first exemplary embodiment. At that time, each of a main body fixing portions 27*y* (refer to FIG. 3 as well) that is provided on both side portions of the housing 27 of the laser exposing unit 20 is fixed to corresponding one of attachment units 104 of the holding jig 100. Thereby a predetermined positional relationship between the laser exposing unit 20 and the holding jig 100 is set.

When the holding jig 100 is attached to the laser exposing unit 20, both end portions of each of irradiation side lenses 26K, 26C, 26M and 26Y is held by corresponding lens holding units 102K, 102C, 102M or 102Y of the holding jig 100. Each of the lens holding units 102K, 102C, 102M and 102Y is supported by a casing 101 of the holding jig 100 so that each of the lens holding units 102K, 102C, 102M and 102Y is movable in parallel in the up and down direction. Each of the lens holding units 102K, 102C, 102M and 102Y is configured so as to finely adjust a position in the up and down direction by corresponding one of adjusting units 103K, 103C, 103M and 103Y that is provided with a micrometer.

Therefore, by finely adjusting the position in the up and down direction of each of the lens holding units 102K, 102C, 102M and 102Y that supports the both end portions of corresponding one of the irradiation side lenses 26K, 26C, 26M and 26Y, each of the set angles θ shown in FIG. 3 is finely adjusted. Thereby, the exposure positions on the photoconductor drum 11 in the main scanning direction and the sub-scanning direction in the laser exposing unit 20 are set with high accuracy. The setting is performed as a second process in the manufacturing process of the laser exposing unit 20 according to the first exemplary embodiment.

As mentioned above, after finishing the setting of the exposure positions in the laser exposing unit 20 with using the measuring apparatus, each of the irradiation side lenses 26K, 26C, 26M and 26Y is fixed to the lens supporting frame 29 that is arranged in the both side portions of the housing 27 of the laser exposing unit 20. At the time, in each laser exposing unit 20 according to the first exemplary embodiment, each of the irradiation side lenses 26K, 26C, 26M and 26Y is fixed with using an adhesive such as an ultraviolet cure adhesive.

Figure 5:
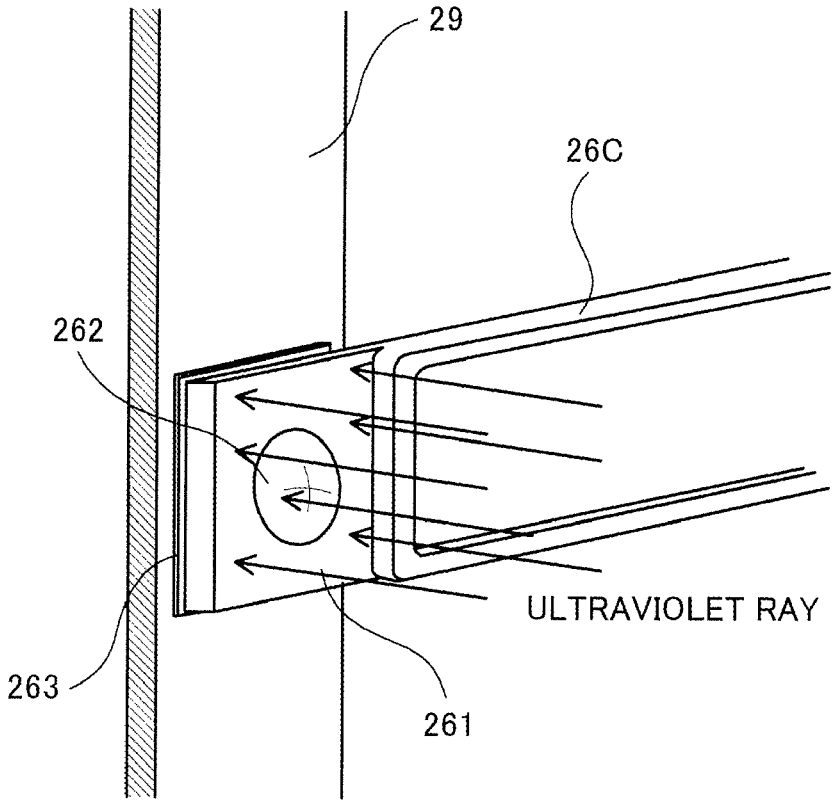
FIG. 5 is a perspective view that explains a state where one end portion of the irradiation side lens is fixed to the lens supporting frame as an example.

FIG. 5 is a perspective view that explains a state where one end portion of the irradiation side lens 26C is fixed to the lens supporting frame 29 as an example. As shown in FIG. 5, in both end portions of the irradiation side lens 26C, a lens fixing unit 261 is formed at a position opposed to the lens supporting frame 29. Further, in a partial area of the lens fixing unit 261, a light collecting unit 262 formed in a convex lens shape is formed.

In addition, between the lens supporting frame 29 and the lens fixing unit 261, there is provided with an ultraviolet cure adhesive layer 263 that is cured by irradiation of ultraviolet ray, and that adheres to and fixes the lens supporting frame 29 and the lens fixing unit 261. By the ultraviolet irradiation from the exterior, the both end portions of the irradiation side lens 26C are fixed to the lens supporting frame 29. The above configuration is similarly applied to the other irradiation side lenses 26K, 26M and 26Y.

Figure 6A:
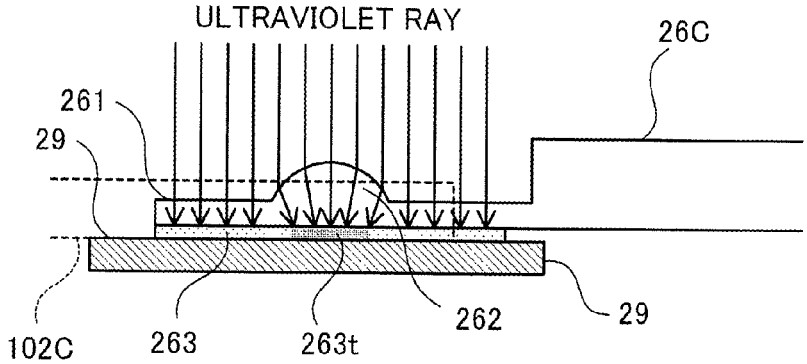
FIGS. 6A to 6C are views that explain an example of the process of fixing each of the irradiation side lenses to the lens supporting frame.
Figure 6B:
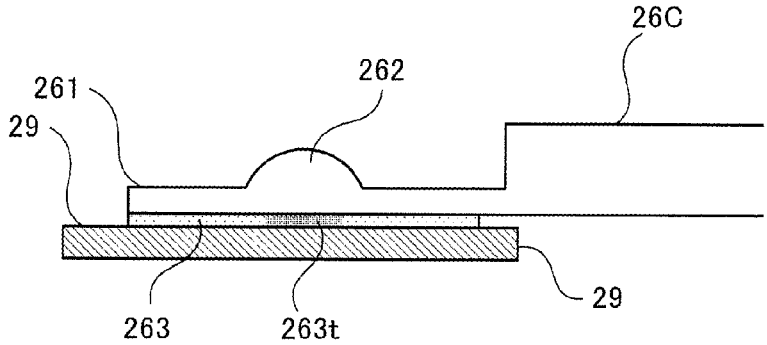
Figure 6C:
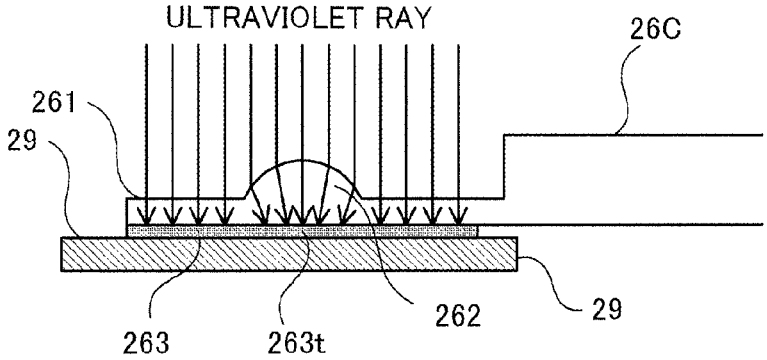

Here, a description is given to a process of fixing each of the irradiation side lenses 26K, 26C, 26M and 26Y to the lens supporting frame 29 in the laser exposing unit 20 according to the first exemplary embodiment. FIGS. 6A to 6C are views that explain an example of the process of fixing each of the irradiation side lenses 26K, 26C, 26M and 26Y to the lens supporting frame 29.

FIG. 6A is a view that explains a third process in the manufacturing process of the laser exposing unit 20 according to the first exemplary embodiment. After finishing the fine-adjustment of each of the irradiation side lenses 26K, 26C, 26M and 26Y with using the measuring apparatus, the third process is performed in a state where the holding jig 100 is still attached to the laser exposing unit 20 (refer to FIG. 4). That is, the irradiation side lenses 26K, 26C, 26M and 26Y adjusted to positions for setting the exposure positions in the main scanning direction and the sub-scanning direction with high accuracy after the adjustment with the measuring apparatus is finished are held by the holding jig 100 in a state where the irradiation side lenses 26K, 26C, 26M and 26Y are not yet fixed to the lens supporting frame 29. In the laser exposing unit 20 according to the first exemplary embodiment, ultraviolet irradiation is performed to the lens fixing unit 261 in a relatively short time in the above stage so as to cure only the ultraviolet cure adhesive layer 263 of an area 263*t* serving as an example of a first adhering unit that is opposed to the light collecting unit 262 formed in the partial area of the lens fixing unit 261.

In general, a long time is required in order to cure all areas of the ultraviolet cure adhesive layer 263 that is provided in the area opposed to the lens fixing unit 261. Therefore, in order not to generate displacement of the irradiation side lenses 26K, 26C, 26M and 26Y whose positions are adjusted, there is a need for sustaining a state where the holding jig 100 is attached to the laser exposing unit 20 until the ultraviolet cure adhesive layer 263 is cured. In order to set the exposure positions of the laser exposing unit 20 with high accuracy, the holding jig 100 is required to sustain a predetermined positional relationship with the measuring apparatus. In general, the holding jig 100 is installed integrally with the measuring apparatus. Therefore, provided that a state where the holding jig 100 is attached to the laser exposing unit 20 is sustained until all areas of the ultraviolet cure adhesive layer 263 is cured, the measuring apparatus is to be occupied during the curing time. As a result, the time period when other laser exposing units 20 are not adjusted becomes longer, so that a production efficiency of the laser exposing unit 20 is decreased.

Therefore, in the laser exposing unit 20 according to the first exemplary embodiment, when the adjustment with using the measuring apparatus is finished, the ultraviolet irradiation is performed to the lens fixing unit 261 in a relatively short time so as to cure only the ultraviolet cure adhesive layer 263 of the area 263*t* that is opposed to the light collecting unit 262 formed in the partial area of the lens fixing unit 261. Thereby, in each of the irradiation side lenses 26K, 26C, 26M and 26Y whose position is adjusted by the measuring apparatus, with strength of such an extent that the displacement is not generated by work operated in the following manufacturing process, each of the irradiation side lenses 26K, 26C, 26M and 26Y is temporarily fixed to the lens supporting frame 29. The holding jig 100 is detached from the laser exposing unit 20 in a relatively short time.

In the laser exposing unit 20 according to the first exemplary embodiment, the light collecting unit 262 formed in a convex lens shape is formed in the partial area of the lens fixing unit 261. Thereby, the ultraviolet ray that is irradiated to the lens fixing unit 261 is collected by the light collecting unit 262 and the area 263*t* in which the ultraviolet ray is concentrated is formed in the ultraviolet cure adhesive layer 263. Thereby, strong ultraviolet ray is intensively irradiated in the area 263*t* and a resin is cured in a relatively short time. Therefore, in the area 263*t*, each of the irradiation side lenses 26K, 26C, 26M and 26Y is fixed to the lens supporting frame 29. In the above stage, areas of the ultraviolet cure adhesive layer 263 other than the area 263*t* are not yet cured. However, by the area 263*t*, the strength is set to such an extent that the displacement of each of the irradiation side lenses 26K, 26C, 26M and 26Y is not generated by the work in the following manufacturing process of the laser exposing unit 20.

Therefore, duration of irradiating the ultraviolet ray to the lens fixing unit 261 in the third process is set to the curing time of the area 263*t* where the ultraviolet ray is concentrated by the light collecting unit 262. The above curing time is extremely shorter than the curing time of all areas of the ultraviolet cure adhesive layer 263.

It should be noted that in the third process mentioned above, a treatment of performing the ultraviolet irradiation to the lens fixing unit 261 in each of irradiation side lenses 26K, 26C, 26M and 26Y, and curing only the ultraviolet cure adhesive layer 263 of the area 263*t* that is opposed to the light collecting unit 262 of the lens fixing unit 261 may be performed when the adjustment with using the measuring apparatus is finished for all the irradiation side lenses 26K, 26C, 26M and 26Y. The treatment may be performed for each of the irradiation side lenses 26K, 26C, 26M and 26Y successively when the adjustment with using the measuring apparatus is finished for each of the irradiation side lenses 26K, 26C, 26M and 26Y.

Next, FIG. 6B is a view that explains a fourth process in the manufacturing process of the laser exposing unit 20 according to the first exemplary embodiment. In the fourth process, after curing only the ultraviolet cure adhesive layer 263 of the area 263*t* that is opposed to the light collecting unit 262 formed in the partial area of the lens fixing unit 261, the holding jig 100 is detached from the laser exposing unit 20.

Next, FIG. 6C is a view that explains a fifth process in the manufacturing process of the laser exposing unit 20 according to the first exemplary embodiment. In the fifth process, in a state where the holding jig 100 is detached from the laser exposing unit 20, sufficient ultraviolet ray is irradiated to all areas of the ultraviolet cure adhesive layer 263. Thereby, the ultraviolet cure adhesive layer 263 other than the area 263*t* serving as an example of a second adhering unit is sufficiently cured.

As mentioned above, in the laser exposing unit 20 according to the first exemplary embodiment, when the adjustment with using the measuring apparatus is finished, only the partial area 263*t* of the ultraviolet cure adhesive layer 263 is cured. After the laser exposing unit 20 is detached from the measuring apparatus (the holding jig 100), sufficient ultraviolet ray is irradiated to all areas of the ultraviolet cure adhesive layer 263, and all areas of the ultraviolet cure adhesive layer 263 are sufficiently cured.

Here, the area 263*t* of the ultraviolet cure adhesive layer 263 according to the first exemplary embodiment is formed in an area within the ultraviolet cure adhesive layer 263. However, when the adjustment with using the measuring apparatus is finished, the area 263*t* to be cured by the ultraviolet irradiation may be separately formed in the exterior of the ultraviolet cure adhesive layer 263.

As mentioned above, in the laser exposing unit 20 according to the first exemplary embodiment, when the adjustment with using the measuring apparatus is finished, only the partial area 263*t* of the ultraviolet cure adhesive layer 263 is cured. After the laser exposing unit 20 is detached from the measuring apparatus (the holding jig 100), sufficient ultraviolet ray is irradiated to all areas of the ultraviolet cure adhesive layer 263, and all areas of the ultraviolet cure adhesive layer 263 are sufficiently cured.

Second Exemplary Embodiment

In the first exemplary embodiment, the description is given to the configuration where the light collecting unit 262 is formed in the partial area of the lens fixing unit 261, and when the adjustment with using the measuring apparatus is finished, only the partial area 263*t* of the ultraviolet cure adhesive layer 263 is cured. In the second exemplary embodiment, a description is given to a configuration where a thinly formed adhesive layer being curable in a short time is provided in the ultraviolet cure adhesive layer 263. It should be noted that the same reference numerals are used for the same configuration as in the first exemplary embodiment, and a detailed explanation thereof is omitted.

Figure 7A:
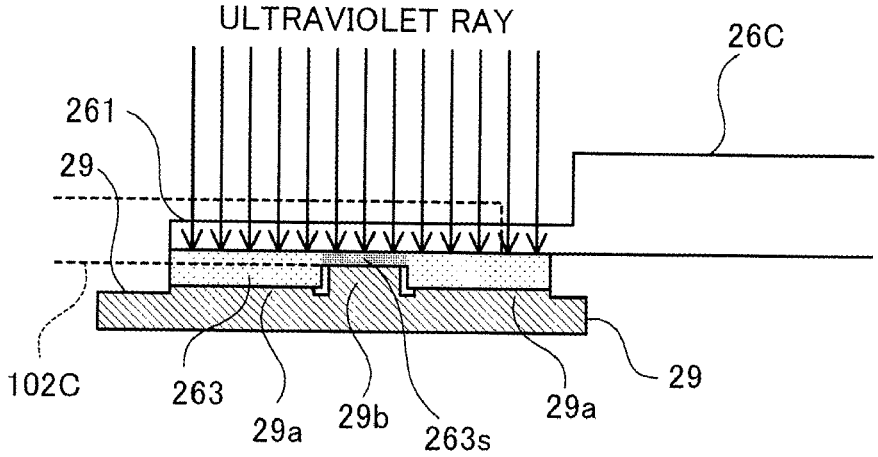
FIGS. 7A to 7C are views that explain an example of a process of fixing each of the irradiation side lenses to the lens supporting frame in the laser exposing unit according to the second exemplary embodiment.
Figure 7B:
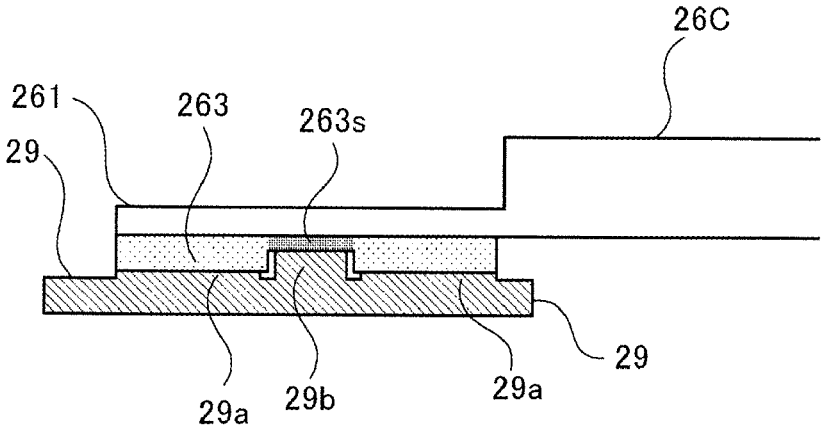
Figure 7C:
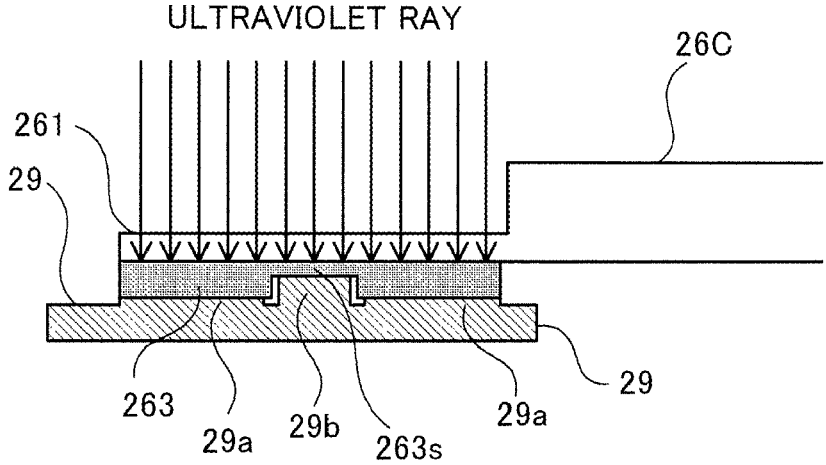

FIGS. 7A to 7C are views that explain an example of a process of fixing each of the irradiation side lenses 26K, 26C, 26M and 26Y to the lens supporting frame 29 in the laser exposing unit 20 according to the second exemplary embodiment.

FIG. 7A is a view that explains a third process in the manufacturing process according to the second exemplary embodiment performed after the first and second processes mentioned above. After finishing the fine-adjustment of each of the irradiation side lenses 26K, 26C, 26M and 26Y with using the measuring apparatus, the third process here is performed in a state where the holding jig 100 is still attached to the laser exposing unit 20 (refer to FIG. 4). In the laser exposing unit 20 according to the second exemplary embodiment, an area 263*s* serving as an example of the first adhering unit on which a thinner (less) adhesive is coated than that on other areas is formed, for example, at a central portion of the ultraviolet cure adhesive layer 263. Thereby, by the ultraviolet irradiation to the lens fixing unit 261 in a relatively short time, only the area 263*s* in the ultraviolet cure adhesive layer 263 is cured.

It should be noted that in the lens supporting frame 29 that is opposed the lens fixing unit 261, a high convex portion 29*b* that corresponds to the area 263*s* with a thin adhesive layer and a flat portion 29*a* that corresponds to areas coated with a sufficiently thick adhesive layer (areas other than the area 263*s*) are provided.

Thereby, in the area 263*s*, each of the irradiation side lenses 26K, 26C, 26M and 26Y is fixed to the lens supporting frame 29. In the above stage, the areas of the ultraviolet cure adhesive layer 263 other than the area 263*s* are not yet cured. However, by the area 263*s*, the strength is set to such an extent that the displacement of each of the irradiation side lenses 26K, 26C, 26M and 26Y is not generated by the work in the following manufacturing process of the laser exposing unit 20.

In the above case, duration of irradiating the ultraviolet ray to the lens fixing unit 261 in the third process is set to the curing time of the area 263*s* with the thin adhesive layer. The above curing time is extremely shorter than the curing time of all areas of the ultraviolet cure adhesive layer 263.

It should be noted that, in each of the lens fixing units 261 in the both end portions of the irradiation side lens 26C, at a position opposed to the area 263*s* with the thin adhesive layer, a light collecting unit formed in a convex lens shape similar to that in the first exemplary embodiment may be formed.

Next, FIG. 7B is a view that explains a fourth process in the manufacturing process of the second exemplary embodiment. In the fourth process, after curing only the ultraviolet cure adhesive layer 263 of the area 263*s*, the holding jig 100 is detached from the laser exposing unit 20.

Next, FIG. 7C is a view that explains a fifth process in the manufacturing process of the second exemplary embodiment. In the fifth process, in a state where the holding jig 100 is detached from the laser exposing unit 20, sufficient ultraviolet ray is irradiated to all areas of the ultraviolet cure adhesive layer 263. Thereby, the ultraviolet cure adhesive layer 263 in an area with coating a sufficient thickness of an adhesive other than the area 263*s* serving as an example of a second adhering unit is sufficiently cured.

As mentioned above, in the laser exposing unit 20 according to the second exemplary embodiment, when the adjustment with using the measuring apparatus is finished, only the partial area 263*s* of the ultraviolet cure adhesive layer 263 is cured. After the laser exposing unit 20 is detached from the measuring apparatus (the holding jig 100), sufficient ultraviolet ray is irradiated to all areas of the ultraviolet cure adhesive layer 263, and the ultraviolet cure adhesive layer 263 on an area formed with an sufficient amount of the adhesive are cured.

It should be noted that the present exemplary embodiment may be figured out as the following exemplary embodiment.

An exposure apparatus manufacturing method is provided with: holding an optical member with a first adhering unit of a holding member, the first adhering unit being cured by light irradiation for first duration; and holding the optical member with a second adhering unit of the holding member, the second adhering unit being cured by light irradiation for second duration which is longer than the first duration.

An image forming method is provided with: exposing an image holding body with an exposure device to make an electrostatic latent image on the image holding body; developing the electrostatic latent image with a developer to form a toner image; transferring the toner image onto a recording medium; and fixing the toner image onto the recording medium. The exposure device has: a light source; an optical member that is arranged on a light route of light irradiated from the light source; and a holding member that holds the light source and the optical member. Both end portions of the optical member are held by the holding member with a first adhering unit that is cured by light irradiation for first duration and a second adhering unit that is cured by light irradiation for second duration which is longer than the first duration.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure apparatus comprising:

an optical member; and a holding member that holds the optical member, two end portions of the optical member being held by the holding member with a first adhering unit that is cured by light irradiation for a first duration and a second adhering unit that is cured by light irradiation for a second duration which is longer than the first duration, wherein the optical member is equipped with a light collecting unit that collects the irradiated light to the first adhering unit at a position opposed to the first adhering unit in each of the two end portions.

2. The exposure apparatus according to claim 1, wherein the optical member arranges a convex lens at a position opposed to the first adhering unit in each of the two end portions.

3. The exposure apparatus according to claim 1, wherein the first adhering unit is formed in a thinner layer than the second adhering unit.

4. The exposure apparatus according to claim 3, wherein the holding member arranges a convex portion at a position corresponding to the first adhering unit.

5. The exposure apparatus according to claim 1, wherein the first adhering unit is arranged adjacent to the second adhering unit.

6. The exposure apparatus according to claim 1, wherein the second adhering unit has a stronger adhering force than the first adhering unit.

7. The exposure apparatus according to claim 1, wherein the optical member is configured such that light from a light source passes through the optical member, and wherein the optical member is arranged adjacent to an exposed body that is exposed to the light from the light source.

8. An image forming apparatus comprising:

an image holding body; and an exposure device that exposes the image holding body, the exposure device having:

a light source;

an optical member that is arranged on a light route of light irradiated from the light source; and a holding member that holds the light source and the optical member, two end portions of the optical member being held by the holding member with a first adhering unit that is cured by light irradiation for a first duration and a second adhering unit that is cured by light irradiation for a second duration which is longer than the first duration, wherein the exposure device is equipped with a light collecting unit that collects the irradiated light to the first adhering unit, at a position opposed to the first adhering unit on the optical member.

9. The image forming apparatus according to claim 8, wherein the light collecting unit of the exposure device is configured as a convex lens.

10. The image forming apparatus according to claim 8, wherein the first adhering unit of the exposing device is configured in a thinner layer than the second adhering unit of the exposing device.

11. The image forming apparatus according to claim 10, wherein the exposure device arranges a convex portion at a position where the holding member corresponds to the first adhering unit.

12. The image forming apparatus according to claim 8, further comprising:

a plurality of image holding bodies; and wherein the exposure device comprises:

a plurality of light sources that expose each of the plurality of image holding bodies; and a plurality of optical members that are arranged corresponding to each of the plurality of light sources.

13. An image forming method comprising:

exposing an image holding body with an exposure device to make an electrostatic latent image on the image holding body;

developing the electrostatic latent image with a developer to form a toner image;

transferring the toner image onto a recording medium; and fixing the toner image onto the recording medium; wherein the exposure device has:

a light source;

an optical member that is arranged on a light route of light irradiated from the light source; and a holding member that holds the light source and the optical member, two end portions of the optical member being held by the holding member with a first adhering unit that is cured by light irradiation for a first duration and a second adhering unit that is cured by light irradiation for a second duration which is longer than the first duration, wherein the exposure device is equipped with a light collecting unit that collects the irradiated light to the first adhering unit, at a position opposed to the first adhering unit on the optical member.

* * * * *